US006160982A

United States Patent [19]

Chow

[11] Patent Number: 6,160,982

[45] Date of Patent: Dec. 12, 2000

[54] COPY SHEET DISTORTION-REMOVING FUSING APPARATUS

[75] Inventor: Che C. Chow, Penfield, N.Y.

[73] Assignee: Xerox Corporation, Stamford, Conn.

[21] Appl. No.: 09/411,217

[22] Filed: Oct. 4, 1999

[51] Int. Cl.[7] ..... G03G 15/20

[52] U.S. Cl. ..... 399/322; 399/406

[58] Field of Search ..... 399/322, 400, 399/406, 320; 271/161, 188, 209; 162/270, 271

[56] References Cited

U.S. PATENT DOCUMENTS

| | | | |
|---|---|---|---|
| 4,541,705 | 9/1985 | Knechtel | 399/320 |
| 5,087,947 | 2/1992 | Torino | 399/320 |
| 5,187,527 | 2/1993 | Forlani et al. | 399/322 |
| 5,319,430 | 6/1994 | DeBolt et al. | 399/322 |
| 5,396,318 | 3/1995 | Asada | 399/406 |
| 5,870,662 | 2/1999 | Tomatsu | 399/406 |
| 6,002,913 | 12/1999 | Pawlik et al. | 399/406 |

*Primary Examiner*—William J. Royer
*Attorney, Agent, or Firm*—Tallam I. Nguti

[57] ABSTRACT

A copy sheet distortion-removing fusing apparatus is provided for preventing fused image deletions and poor fused copy sheet appearance. The copy sheet distortion-removing fusing apparatus includes a frame; a first pair of rotatable rollers mounted to the frame and forming a first nip for receiving and moving a copy sheet therethrough. The first pair of rotatable rollers includes a heated fuser roller, and a pressure roller forming the first nip against the fuser roller. The copy sheet distortion-removing fusing apparatus also includes a second pair of rotatable rollers forming a second nip for immediately receiving and moving therethrough a fused copy sheet coming from the first nip. Each roller of the second pair of rotatable rollers includes a hard surface layer. Rollers of the second pair of rollers are mounted in pressure engagement against each other within the second nip for flattening out any distortions in the fused copy sheet being moved therethrough, thereby preventing poor fused copy sheet appearance on such fused copy sheet.

6 Claims, 1 Drawing Sheet

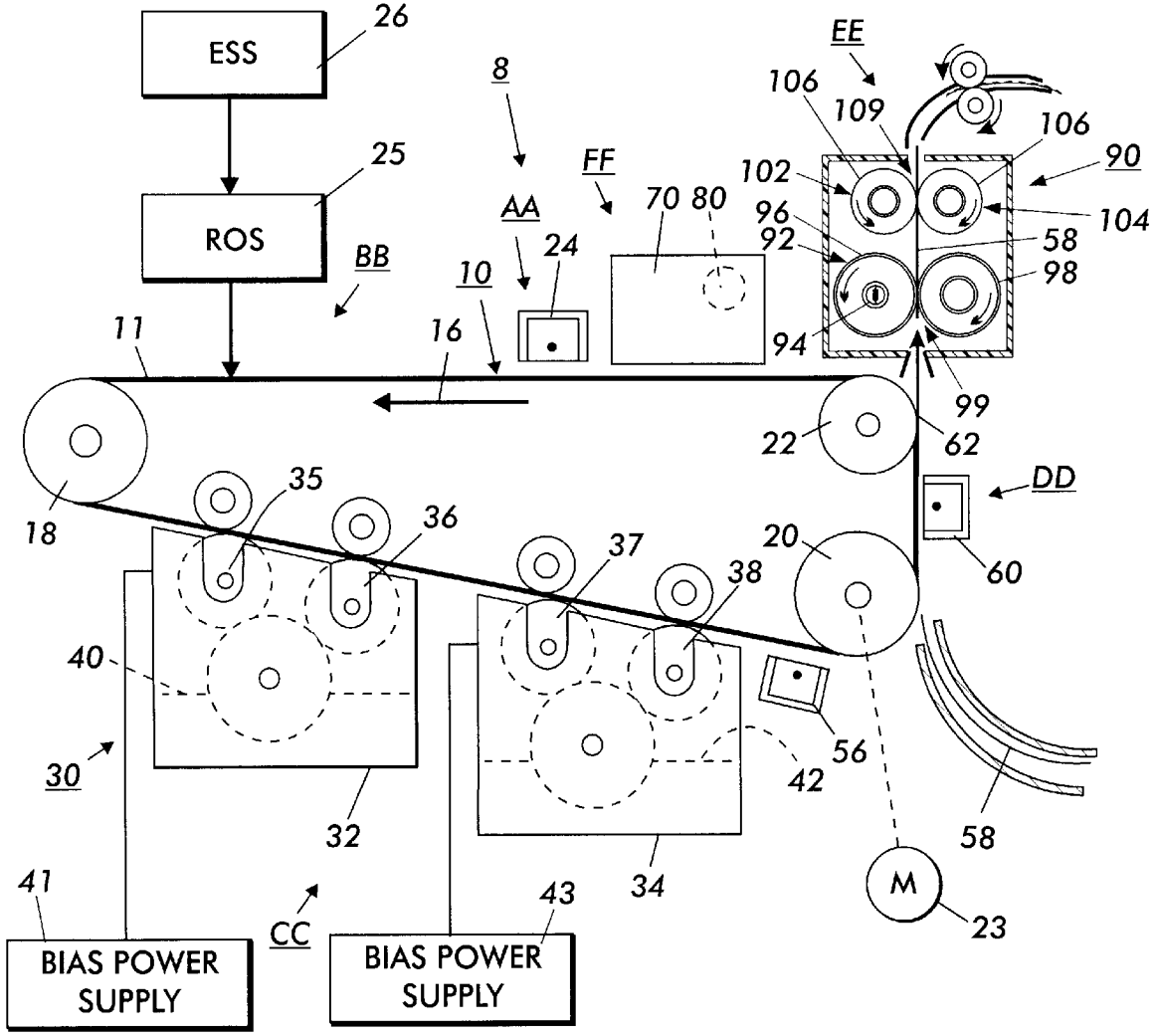
The Figure

COPY SHEET DISTORTION-REMOVING FUSING APPARATUS

BACKGROUND OF THE INVENTION

This invention relates generally to electrostatographic reproduction machines, and more particularly to a fused copy sheet distortion-removing fusing apparatus for use in such a machine to fuse toner images on sheets without image defects caused by initial heat and pressure distortion of the sheets.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith.

Generally, the developer material comprises toner particles adhering triboelectrically to carrier granules. The toner particles are attracted from the carrier granules either to a donor roller or to a latent image on the photoconductive member. The toner attracted to a donor roller is then deposited on a latent electrostatic images on a charge retentive surface which is usually a photoreceptor. The toner powder image is then transferred from the photoconductive member to a copy substrate or sheet. The copy substrate or sheet carrying the powder image is then moved to a heat and pressure fusing apparatus, for example, where the toner powder particles are heated in order to fuse and permanently affix them to the copy substrate or sheet.

A problem encountered with an ordinary heat and pressure fuser or fusing apparatus is that the substrate or sheet, usually a sheet of paper, distorts upon being heated within a heated fusing nip of the heat and pressure fusing apparatus. Such sheet distortion is especially pronounced in a roller type heat and pressure fusing apparatus if the heated fuser roller of such apparatus has a soft surface coating, for example of silicone rubber. In general, the distortion is also very pronounced in the case of sheets of coated paper. Such distortions cause not only undesirable fused copy sheet appearance, but also image deletions when the sheet is repassed in a duplex operation to receive a second image on the other side thereof.

SUMMARY OF THE INVENTION

According to the present invention, there is provided a copy sheet distortion-removing fusing apparatus is provided for preventing fused image deletions and poor fused copy sheet appearance. The copy sheet distortion-removing fusing apparatus includes a frame; a first pair of rollers mounted to the frame and forming a first nip for receiving and moving a copy sheet therethrough. The first pair of rotatable rollers includes a heated fuser roller, and a pressure roller forming the first nip against the fuser roller. The copy sheet distortion removing fusing apparatus also includes a second pair of rotatable rollers forming a second nip for immediately receiving and moving therethrough a fused copy sheet coming from the first nip. Each roller of the second pair of rollers includes a hard surface layer. Rollers of the second pair of rollers are mounted in pressure engagement against each other within the second nip for flattening out any distortions in the fused copy sheet received and being moved therethrough, thereby preventing fused image deletions and poor fused copy sheet appearance on such fused copy sheet.

DESCRIPTION OF THE DRAWINGS

In the detailed description of the invention presented below, reference is made to the drawings, in which:

The FIGURE is a schematic illustration of an electrostatographic reproduction machine incorporating the copy sheet distortion-removing fusing apparatus of the present invention.

DETAILED DESCRIPTION OF THE INVENTION

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to the drawing (FIG. 1), where the showings are for the purpose of describing a preferred embodiment of the invention and not for limiting same, and where the various processing stations employed in an electrostatographic reproduction machine as illustrated in FIG. 1, will be described only briefly. As illustrated, an electrostatographic reproduction machine 8, in which the present invention finds advantageous use, utilizes a charge retentive image bearing member in the form of a photoconductive belt 10 consisting of a photoconductive surface 11 and an electrically conductive substrate. The belt 10 is mounted for movement past a series of electrostatographic process stations including a charging station M, an exposure station BB, developer stations CC, transfer station DD, fusing station EE and cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Roller 20 is coupled to motor 23 by suitable means such as a belt drive. Motor 23 rotates roller 20 to advance belt 10 in the direction of arrow 16.

As can be seen by further reference to FIG. 1, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station BB. At exposure station BB, the uniformly charged photoreceptor or charge retentive surface 10 is exposed to a laser based input and/or output scanning device 25 which, as controlled by controller or ESS 26, causes the charge retentive surface to be discharged in accordance with the output from the scanning device. The ESS 26, for example, is the main multi-tasking processor for operating and controlling all of the other machine subsystems and printing operations, including aspects of the present invention. The scanning device is a three level laser Raster Output Scanner (ROS). The resulting photoreceptor contains both charged-area images and discharged-area images.

At development station CC, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43. Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 towards a fusing station EE.

Still referring to the Figure, fusing station EE includes a copy sheet distortion-removing fusing apparatus 90 in accordance with the present invention. As illustrated, the copy sheet distortion-removing fusing apparatus 90 includes a first pair of rollers comprising a rotatable fuser roller 92 that is heated for example by a heating device 94 (shown as an internal lamp but as well could be an external heater) for elevating temperatures of the surface 96 of the fuser roller to a suitable toner fusing temperature. The first pair of rollers also comprise a rotatable pressure roller 98 that forms a first nip 99 against the rotatable fuser roller 92. At least one of the first pair of rollers 92, 98 has a soft surface layer. As shown, the first nip 99 is a heat and pressure fusing nip through which copy substrates or sheets 58 each carrying a transferred toner image thereon can be moved, with the rollers 92 and 98 contacting the full width or length of the sheet 58, and not just its edges.

As is pointed out above, moving a copy substrate or sheet 58 through a heat and pressure fusing nip as such heats and fuses the toner particles forming the toner image, but it also unfortunately heats the substrate or sheet 58 thereby tending to distort the substrate or sheet 58. Such substrate or sheet distortion is especially pronounced in a roller type heat and pressure fusing apparatus as the apparatus 90, and particularly if the substrate or sheet 58 is coated paper. Such distortions cause not only undesirable fused copy sheet appearance, but also image deletions when the sheet is repassed in a duplex operation to receive a second image on the other side thereof.

It has been found that when the substrate or sheet of paper such as 58 is heated in a fusing nip by a fuser roller that has a soft rubber coating and a pressure roll that is hard, the distortion is in the form of waves parallel to the process direction (that is the direction of sheet movement). On the other hand, the distortion takes on a fan shape if both the pressure roll and the fuser roll are soft.

In either case, the distortion arises from thermal and hydroexpansion of the sheet of paper within the hot nip, as well as from stress relaxation. As also pointed out above, such distortion is relatively more severe in the case of coated paper as compared to uncoated paper. It is believed that this is due to weaker mechanical strength of coated paper of similar weight as the uncoated paper. What is significant is that irrespective of the shape of the distortion, it can cause image deletions and poor fused copy sheet appearance. Accordingly, such distortions ordinarily can be expected to occur on images and substrates or sheets 58 coming through the first fusing nip 99 of the copy sheet distortion-removing fusing apparatus 90.

To eliminate or reverse such distortions and thus prevent image deletions (when doing duplex copying), and poor fused copy sheet appearance, the copy sheet distortion-removing fusing apparatus 90 of the present invention importantly includes a second pair of rollers 102, 104. As shown, the second pair of rollers 102, 104 form a second nip 109 through which otherwise distorted sheets from the first nip 99 are passed immediately after exiting the first nip 99. The second pair of rollers 102 and 104 are arranged to contact the full width or length of the sheet 58, and not just its edges. As shown, the second nip 109 is a pressure nip formed by the second pair of rollers, shown as sheet flattening rollers 102 and 104, and which function to immediately flatten out any waves or distortions induced in the substrate or sheet 58 immediately after fusing in the first nip 99. Preferably both sheet flattening rollers 102, 104 each have a hard surface layer 106 suitable for performing the sheet flattening function. For example, each of the sheet flattening rollers 102, 104 is a metal roller coated with a tetrafluoroethylene resin layer 106 (tetrafluoroethylene resin is sold by E. I. DuPont de Nemours under the trade name Teflon).

As can be seen, there has been provided a copy sheet distortion-removing fusing apparatus is provided for preventing fused image deletions and poor fused copy sheet appearance. The copy sheet distortion-removing fusing apparatus includes a frame; a first pair of rollers mounted to the frame and forming a first nip for receiving and moving a copy sheet therethrough. The first pair of rotatable rollers includes a heated fuser roller, and a pressure roller forming the first nip against the fuser roller. The copy sheet distortion-removing fusing apparatus also includes a second pair of rotatable rollers forming a second nip for immediately receiving and moving therethrough a fused copy sheet coming from the first nip. Each roller of the second pair of rollers includes a hard surface layer. Rollers of the second pair of rollers are mounted in pressure engagement against each other within the second nip for flattening out any distortions in the fused copy sheet received and being moved therethrough, thereby preventing fused image deletions and poor fused copy sheet appearance on such fused copy sheet.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A copy sheet distortion-removing fusing apparatus for preventing poor fused copy sheet appearance, the copy sheet distortion-removing fusing apparatus comprising:

(a) a frame;

(b) a first pair of rotatable rollers mounted to said frame and forming a first nip for receiving and moving a copy sheet therethrough, said first pair of rotatable rollers including a heated fuser roller, and a pressure roller forming said first nip against said fuser roller; and (c) a second pair of rotatable rollers forming a second nip for immediately receiving and moving therethrough a fused copy sheet coming from said first nip, each roller of said second pair of rotatable rollers including a hard surface layer, and rollers of said second pair of rotatable rollers being mounted in pressure engagement against each other within said second nip, for contacting a full width of, and flattening out poor appearance causing distortions in, the fused copy sheet being moved therethrough, thereby preventing poor fused copy sheet appearance on such fused copy sheet.

2. The copy sheet distortion-removing fusing apparatus of claim 1, wherein at least one of said first pair of rotatable rollers has a soft surface layer for enhancing toner image contact and toner image fusing, and wherein the poor appearance causing distortions are in the form of waves parallel to a direction of movement of the copy sheet.

3. The copy sheet distortion-removing fusing apparatus of claim 1, wherein said hard surface layer of each roller of said second pair of rotatable rollers is comprised of a tetrafluoroethylene resin.

4. An electrostatographic reproduction machine comprising:

(a) a movable image bearing member having a toner image carrying surface defining a path of movement therefor;

(b) electrostatographic devices mounted along said path of movement for forming a toner image on said toner image carrying surface;

(c) means for transferring said toner image from said toner image carrying surface onto a copy sheet; and (d) a copy sheet distortion-removing fusing apparatus for heating and fusing said toner image onto said copy sheet, said copy sheet distortion-removing fusing apparatus including:

(i) a frame;

(ii) a first pair of rotatable rollers mounted to said frame and forming a first nip for receiving and moving a copy sheet therethrough, said first pair of rotatable rollers including a heated fuser roller, and a pressure roller forming said first nip against said fuser roller; and (iii) a second pair of rotatable rollers forming a second nip for immediately receiving and moving therethrough a fused copy sheet coming from said first nip, each roller of said second pair of rotatable rollers including a hard surface layer, and rollers of said second pair of rotatable rollers being mounted in pressure engagement against each other within said second nip, for contacting a full width of, and flattening out poor appearance causing distortions in, the fused copy sheet being moved therethrough, thereby preventing poor fused copy sheet appearance on such fused copy sheet.

5. The electrostatographic reproduction machine of claim 4, wherein at least one of said first pair of rotatable rollers has a soft surface layer for enhancing toner image contact and toner image fusing, and wherein the poor appearance causing distortions are in the form of waves parallel to a direction of movement of the copy sheet.

6. The electrostatographic reproduction machine of claim 4, wherein said hard surface layer of each roller of said second pair of rotatable rollers is comprised of a tetrafluoroethylene resin.

* * * * *